US005600961A

United States Patent [19]

Whipple, III

[11] Patent Number: 5,600,961

[45] Date of Patent: Feb. 11, 1997

[54] REFRIGERATION SYSTEM WITH DUAL CYLINDER COMPRESSOR

[75] Inventor: Walter Whipple, III, Amsterdam, N.Y.

[73] Assignee: General Electric Company, Schenectady, N.Y.

[21] Appl. No.: 301,759

[22] Filed: Sep. 7, 1994

[51] Int. Cl.[6] ..... F25B 7/00; F04B 23/04

[52] U.S. Cl. ..... 62/175; 417/62; 417/287

[58] Field of Search ..... 417/415, 534, 417/62, 287; 62/175, 510

[56] References Cited

U.S. PATENT DOCUMENTS

| | | | |
|---|---|---|---|
| 1,580,973 | 4/1926 | Rembold | 417/62 |
| 2,986,907 | 6/1961 | Hoop | 62/510 |
| 4,122,687 | 10/1978 | McKee | 62/156 |
| 4,481,787 | 11/1984 | Lynch | 62/180 |
| 4,743,168 | 5/1988 | Yannascoli | 417/287 X |
| 4,910,972 | 3/1990 | Jaster | 62/335 |
| 4,918,942 | 4/1990 | Jaster | 62/335 |
| 5,103,650 | 4/1992 | Jaster | 62/198 |
| 5,134,859 | 8/1992 | Jaster | 62/503 |

FOREIGN PATENT DOCUMENTS

| | | | |
|---|---|---|---|
| 477955 | 6/1929 | Germany | 62/510 |

OTHER PUBLICATIONS

Donald E. Knoop et al., "An Adaptive Demand Defrost and Two–Zone Control and Monitor System for Refrigeration Products," IEEE Transactions on Industry Applications, vol. 24, No. 2, Mar./Apr. 1988, pp. 337–342.

*Primary Examiner*—William E. Wayner
*Attorney, Agent, or Firm*—Donald S. Ingraham

[57] ABSTRACT

An energy-efficient refrigeration system includes a dual cylinder compressor and a compressor controller coupled to the compressor to control compressor capacity by selection of a predetermined refrigerant flow path through the compressor. The dual cylinder compressor includes first and second cylinders with respective first and second pistons that are horizontally opposed and coupled together by a fixed and non-pivoting connecting rod. The void volume of one cylinder is typically greater than the void volume of the other cylinder, and the compressor typically is a scotch-yoke drive apparatus or, alternatively, a linear voice coil drive apparatus. Respective refrigerant flow paths are established by means of a plurality of control valves disposed in a compressor plumbing manifold, to provide a first-cylinder only flow path, a second-cylinder only flow path, a combined first and second cylinder series flow path and a combined first and second cylinder parallel flow path, thereby providing different compressor capacities for meeting different cooling demands in the refrigerator.

10 Claims, 3 Drawing Sheets

REFRIGERATION SYSTEM WITH DUAL CYLINDER COMPRESSOR

BACKGROUND OF THE INVENTION

This invention relates generally to refrigeration systems and in particular to an energy efficient refrigeration apparatus in a refrigerator to handle different cooling demands.

In most conventional refrigerators, a need for cooling in one refrigerator compartment results in the operation of the all components in the refrigeration apparatus and the delivery cooling air to all compartments in the refrigerator. For example, a thermostatic control detecting a temperature above a set point temperature in one compartment generates a signal to start a compressor, beginning the pumping and compressing of the refrigerant, and simultaneously the evaporator fan is energized to produce air flow over the coils of the evaporator in order to cool air that is directed into the refrigerator compartment. The cooled air then commonly passes into a plenum in the refrigerator in which the flow is split such that the majority of the air flow is directed into a freezer compartment and the other portion of the air flow is directed into fresh food compartments of the refrigerator. The split of air flow between the freezer and fresh food compartments is made by a damper that directs the majority of the air flow into the freezer compartment; because the air flow is always split between freezer and fresh food compartments, the refrigeration apparatus always chills the cooling air to a sub-freezing temperature, regardless of which compartment (fresh food or freezer) is in need of cooling. In most conventional refrigerators the position of the damper is either fixed at time of manufacture or adjustable within a small range, either manually by the operator or by an automated control within a limited range of adjustment such that the majority of air flow in all damper settings is still directed to the freezer compartment.

Operation of the refrigerator in this manner results in certain inefficiencies that increase the energy consumption of the refrigerator. Notably, in such arrangements the full capacity of the compressor is always used regardless of the cooling demand that necessitated the start up of the refrigeration apparatus (such as a need for cooling the fresh food but not the freezer compartment).

It is desirable from the standpoint of reducing energy consumption to operate the refrigeration apparatus so as to tune the cooling capacity of the compressor with the cooling demand precipitating the operation of the compressor. For example, use of dual evaporators to meet different cooling demands can improve refrigerator energy efficiency, as is disclosed in U.S. Pat. Nos. 4,910,972; 4,918,942; 5,103,650; and 5,134,859, which are assigned to the assignee of the present invention and which are incorporated herein by reference.

It is thus an object of this invention to provide a refrigeration system that improves the energy efficiency of the refrigerator through selective operation of the compressor at different cooling capacities corresponding to cooling demand in the refrigerator. It is a further object of this invention to provide a dual stage compressor that is readily adapted for use in a dual evaporator refrigeration system.

SUMMARY OF THE INVENTION

In accordance with this invention, an energy-efficient refrigeration system includes a dual cylinder compressor and a compressor controller coupled to the compressor to control compressor capacity by selection of a predetermined refrigerant flow path through the compressor. The dual cylinder compressor comprises first and second cylinders with respective first and second pistons that are horizontally opposed and coupled together by a fixed and non-pivoting connecting rod. The void volume of one cylinder is typically greater than the void volume of the other cylinder. The combined void volume of both cylinders is typically less than 1 cubic inch in a refrigerator that uses Freon 12, Freon 134A, Freon 134B, and similar type of refrigerants. The compressor comprises a scotch-yoke drive apparatus or, alternatively, a linear voice coil drive apparatus. Respective refrigerant flow paths are established by means of a plurality of control valves disposed in a compressor plumbing manifold, the control valves being coupled to the compressor controller to be responsive to control signals therefrom. Respective predetermined refrigerant flow paths selectable by the compressor controller include a first-cylinder only flow path, a second-cylinder only flow path, a first and second cylinder series flow path and a first and second cylinder parallel flow path, thereby providing different compressor capacities for meeting different cooling demands in the refrigerator.

BRIEF DESCRIPTION OF THE DRAWINGS

The features of the invention believed to be novel are set forth with particularity in the appended claims. The invention itself, however, both as to organization and method of operation, together with further objects and advantages thereof, may best be understood by reference to the following description in conjunction with the accompanying drawings in which like characters represent like parts throughout the drawings, and in which:

DETAILED DESCRIPTION OF THE INVENTION

Figure 1:
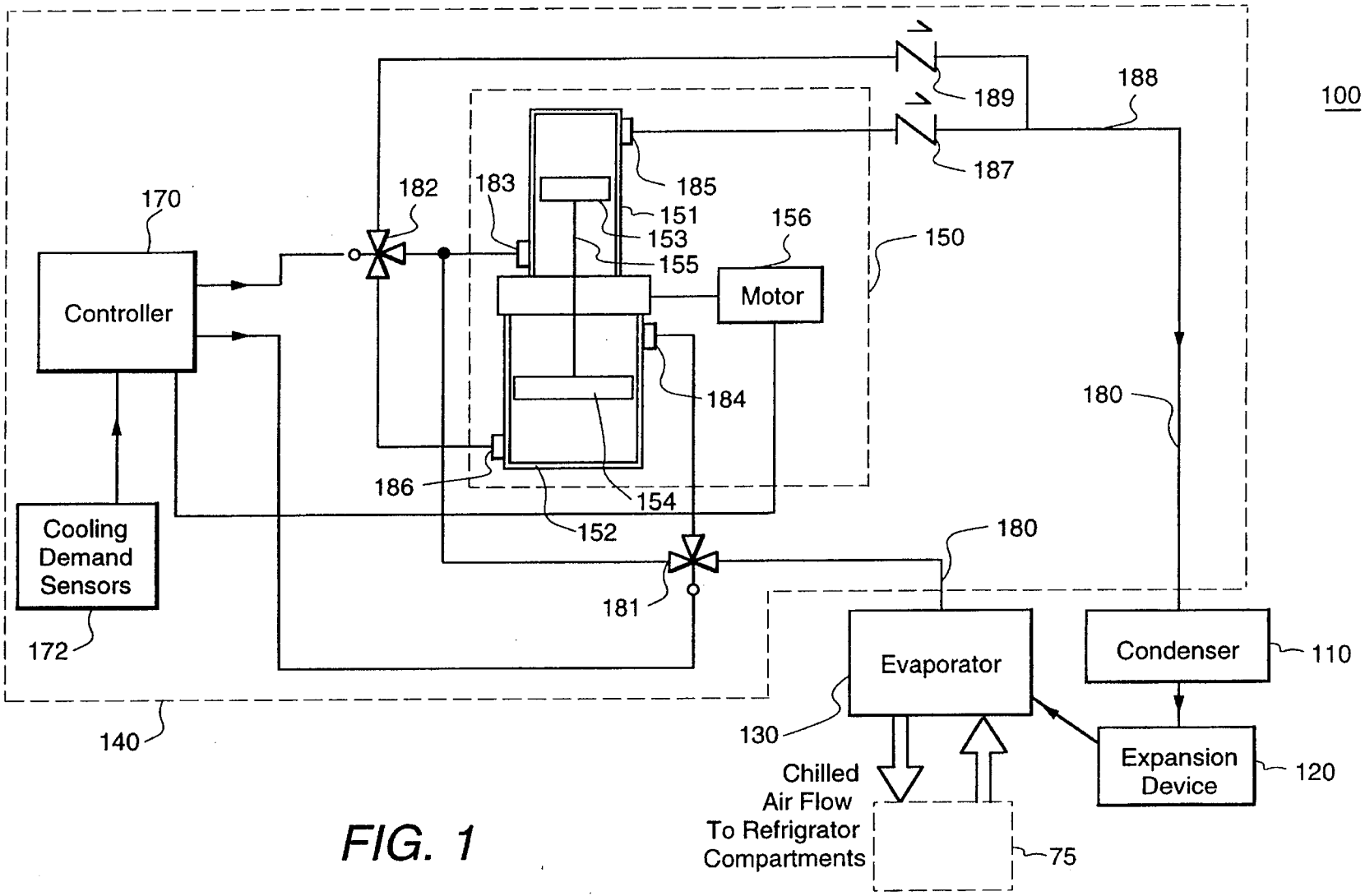
FIG. 1 is a partial schematic and partial block diagram of a refrigeration system in accordance with this invention.

A refrigerator in accordance with this invention comprises a refrigeration system 100 coupled to generate a cooling air flow to cool compartments 75. As used herein, "refrigeration system" refers to devices or combinations of devices that are used to chill (that is, reduce the temperature of) air to a temperature sufficiently low to provide the desired temperatures in compartments 75 in refrigeration system 100. In the present invention, such a system typically comprises a condenser 110, an expansion device 120, an evaporator 130, and a dual-cylinder compressor apparatus 140, which are coupled together such that refrigerant compressed by compressor apparatus 140 is condensed in condenser 110, passes through expansion device 120 into evaporator 130, in which the refrigerant absorbs heat to chill the cooling air that will pass into, or circulate about, the compartments of the refrigerator. Evaporator 130 is coupled to compressor apparatus 140 such that the heated (and typically now-gaseous) refrigerant fluid that enters the compressor is again compressed. Condenser 110 and evaporator 130 are each heat exchangers which transfer energy from and into the refrigerant respectively; expansion device 120 typically comprises a capillary tube, an orifice, an expansion valve, or the like. The refrigerant fluid is a liquid-to-gas phase changing material adapted for a particular refrigeration system; Freon 12, Freon 134A, Freon 134B, propane, butane, or the like are common examples of refrigerants. Refrigeration system 100 further comprises means for causing the flow of chilled air into compartments of the refrigerator in which cooling demand exists. One example of an air-flow control device advantageously used with the dual cylinder compressor apparatus of the present system is disclosed in co-pending application Ser. No. 08/301,761, entitled "Refrigerator Multiplex Damper System", which is assigned to the assignee herein and incorporated herein by reference.

In accordance with this invention, dual cylinder compressor apparatus 140 is a variable capacity compressor apparatus, that is, it is adapted to be selectively controlled to compress different volumes of refrigerant and compress the refrigerant to different pressure differentials dependent upon cooling demands in refrigeration system 100, thereby enhancing the energy efficiency of the refrigerator.

Variable capacity compressor apparatus 140 comprises a dual cylinder compressor 150 having a first cylinder 151 having a first piston 153 disposed therein and a second cylinder 152 having a second piston 154 disposed therein. First and second pistons are coupled together by a fixed, non-pivoting connecting rod 155; connecting rod 155 in turn is coupled to a motor 156 such that the motor drives connecting rod 155 to displace simultaneously the pistons within their respective cylinders. As illustrated in FIG. 1, pistons 153, 154 are horizontally opposed (that is, at either end of connecting rod 155) such that the distance of displacement of a cylinder in one piston is equal to the displacement distance of the other piston in its respective cylinder.

Figure 2B:
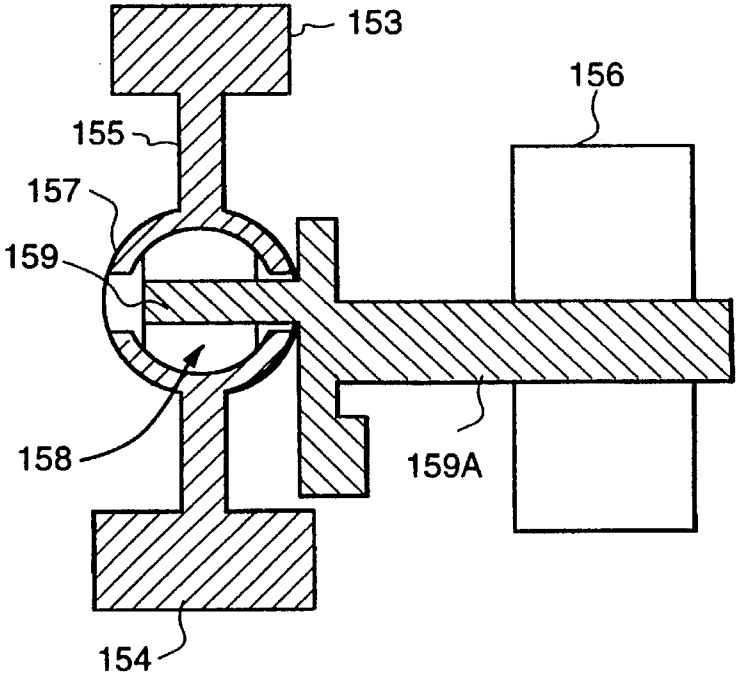
FIG. 2(B) is a cross-sectional view of the dual-cylinder compressor taken along the lines "I—I" of FIG. 2(A)
Figure 2A:
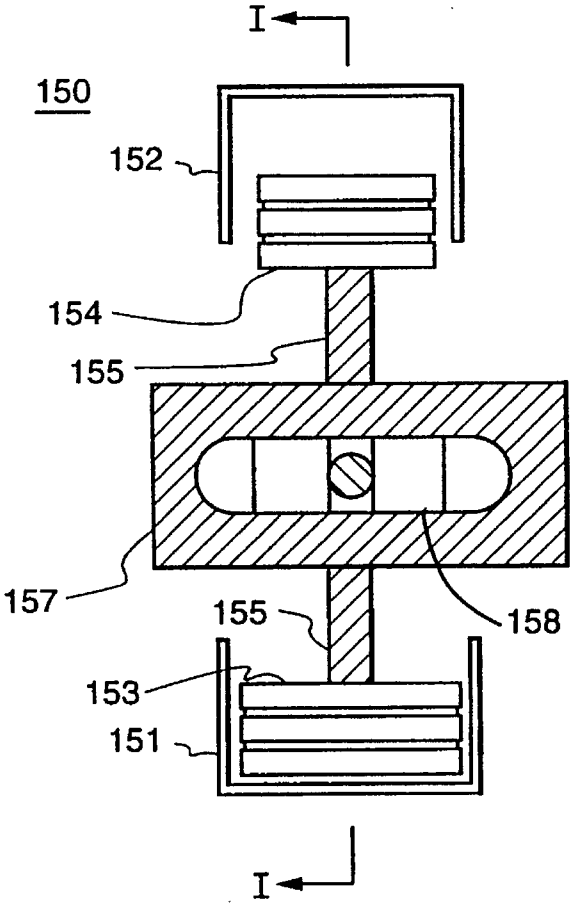
FIG. 2(A) is a cross-sectional view of a dual-cylinder compressor in accordance with one embodiment of the present invention.

One example of dual cylinder compressor 150, known as a "Scotch Yoke" type compressor, is illustrated in greater detail in FIGS. 2(A) and 2(B). Single, non-pivoting connecting rod 155 is coupled to a drive block 157. A crank guide bushing 158 is coupled to a crank shaft drive arm 159, which is off set from center of motor drive shaft 159A. Guide bushing 158 is movably disposed in block 158 such that the rotation of off-set drive arm 159 (corresponding to rotational motion of motor shaft 159A) causes guide bushing to be horizontally displaced (moving back and forth) in block 157 (as illustrated in FIG. 2(A)), and the displacement of off-set drive arm 159 is translated into vertical (up and down as illustrated in FIG. 2(A)) motion of block 157 and connecting rod 155. Thus pistons 153 and 154 are displaced by a corresponding amount for each rotation of motor drive shaft 159A.

Use of a scotch yoke compressor, with the non-pivoting connecting rod, enables the use of a smaller piston skirt as few, if any, lateral or side-acting forces are imparted to the piston, as is common with conventional pivoting piston drive rod arrangements, or single cylinder scotch-yoke type of compressors. The smaller piston skirt area reduces the friction associated with the movement of the piston in the cylinder, thus improving compressor efficiency.

Figure 3:
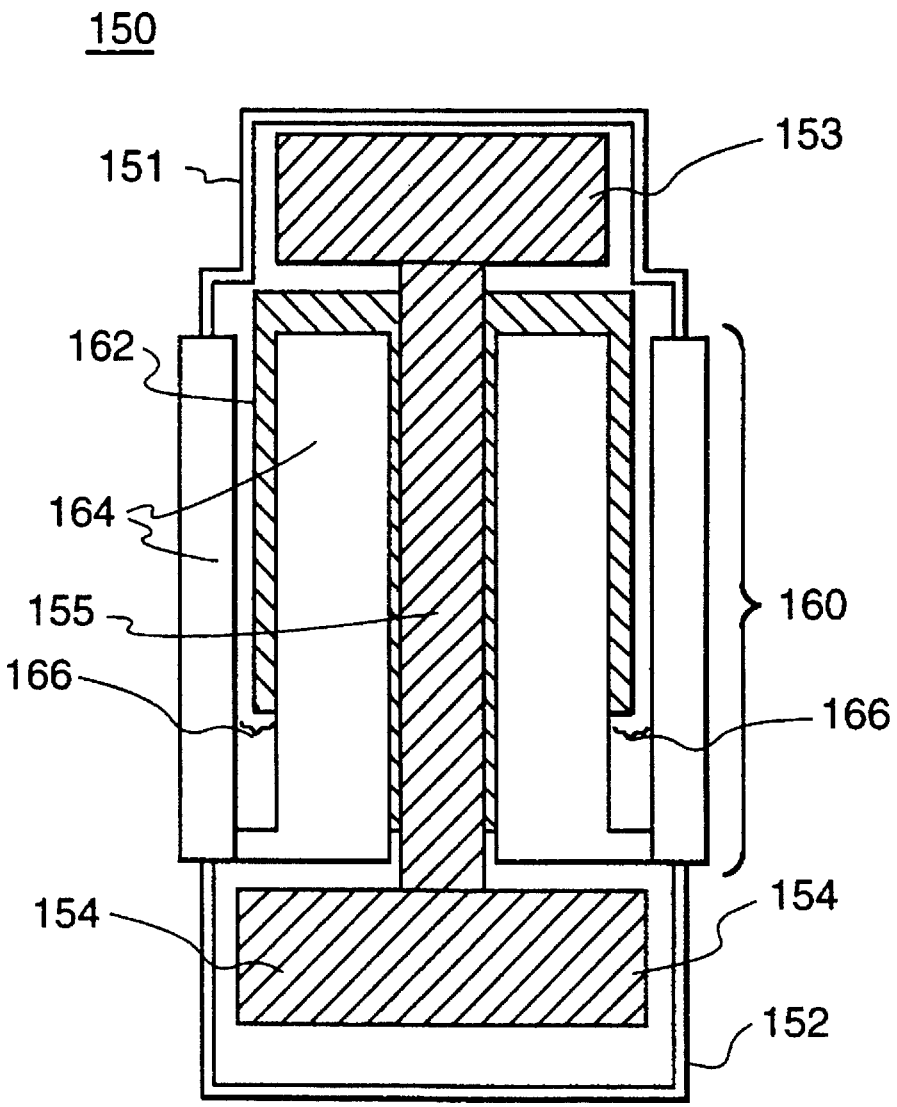
FIG. 3 is a cross-sectional view of a dual-cylinder linear motor compressor in accordance with another embodiment of the present invention.

In another embodiment of the present invention dual cylinder compressor 150 comprises a linear voice coil motor 160 (for ease of illustration in FIG. 3, the actual sizes of respective first and second cylinders 151, 152 with respect to the drive apparatus is not shown). Connecting rod 155 is coupled to a movable armature 162 that is movably disposed within a voice coil magnet 164. An armature current control device is coupled to armature 162 such that current flow through the armature is controlled to determine displacement of the armature within a voice coil magnet housing 166. Single connecting rod 155 is thus displaced in response to motion of armature 162, causing a corresponding displacement of both first and second pistons 153, 154 in their respective cylinders.

In accordance with this invention, the respective void volumes of first and second cylinder 151, 152 are different, thereby providing a variety of compressor capacities dependent upon the operation and line up of refrigerant flow through the compressors. As used herein, "void volume" refers to the maximum effective volume of refrigerant that can be compressed by full displacement of the respective piston in a cylinder during a compression stroke. By means of illustration and not limitation, first cylinder 151 in FIG. 1 has a smaller void volume than second cylinder 152. As the full throw stroke of respective first and second pistons is the same (because they are coupled to single fixed connecting rod 155), the difference in void volume is achieved by the pistons having different respective areas. In a typical household type refrigerator, a representative value of the void volume of first cylinder 151 is about 0.25 $in^3$ and a representative value of the void volume of second cylinder 152 is about 0.4 $in^3$ in refrigeration apparatus using Freon 12, Freon 134A Freon 134B, or similar refrigerants.

Dual cylinder compressor 150 is coupled to a compressor controller 170 and refrigerant plumbing manifold 180 so that a plurality of respective refrigerant flow paths can be established through compressor 150. Compressor controller 170 comprises an analog controller, a digital controller, a microprocessor (also referred to as a micro-controller), or the like which is adapted to determine the cooling demands of respective refrigerator compartments and to generate compressor control signals that control and coordinate the operation of compressor motor 156 (or alternatively, voice coil linear motor 160) and refrigerant plumbing manifold 180 to establish refrigerant flow through the compressor along a selected refrigerant flow path. Controller 170 is coupled to cooling demand sensors 172, such as refrigerator compartment temperature sensors, ambient condition sensors, evaporator condition sensors, defrost sensors, or the like, such that cooling demand in refrigeration system 100 is determined. Specifically, cooling demand may vary dependent upon the desired temperature of the compartment to be cooled (e.g., fresh food or freezer) so that it is desirable to tune compressor operation to expend only the energy necessary to compress refrigerant needed to extract the heat to meet the cooling demand, or alternatively, to operate the compressor motor at the point of its maximum electrical efficiency. Controller 170 may comprise a portion of an overall refrigeration apparatus controller of the type described in co-pending application Ser. No. 08/301,764 entitled "Energy Efficient Refrigerator Control System", which is assigned to the assignee of the present invention and is incorporated herein by reference.

By way of example and not limitation, refrigerant plumbing manifold 180 comprises a first three-way valve 181 and a second three-way valve 182 and associated piping coupling evaporator 130 to the suction of first and second cylinders 151, 152 of dual cylinder compressor 150, and piping coupling the discharge of compressor 150 to condenser 110. Three-way valves 181, 182 typically are each remote-control valves (such as electric solenoid valves) coupled to controller 170 so as to be responsive to control signals generated thereby which direct the position, and hence the refrigerant flow through the valve and associated piping in manifold 180. In the example set out below, control signals from controller 170 are used to position first and second three-way valves as required to establish the selective refrigerant flow paths.

The plurality of refrigerant flow paths through compressor 150 typically includes a first-cylinder only flow path; a second-cylinder only flow path; a combined first and second cylinder in parallel flow path; and, a combined first and second cylinder in series flow path. Operation in a first cylinder only flow path provides refrigerant flow that consumes the least energy and provides the least evaporative chilling (that is, the temperature of the air flowing over the evaporator is reduced the least amount below ambient—e.g., coolest chilling of air could be to about 50° F. for the representative cylinder sizes noted above with a fixed expansion device 120) of the four modes of operation of the compressor. First cylinder 151 comprises the smallest void volume, and is appropriate when cooling demand on the refrigerator is least (e.g., need for cooling fresh food compartments in ambient conditions corresponding to room temperature). For operation in this mode, first three-way valve is positioned to allow refrigerant flow only between evaporator 130 and a first cylinder suction connection 183. Second three-way valve 182 is positioned to isolate first cylinder suction 183 from a second cylinder discharge connection 186. Refrigerant compressed in first cylinder is discharged via a first cylinder discharge connection 185 through a first check valve 187 into manifold outlet piping 188 coupled to condenser 110 (for purposes of illustration, check valve 187 is shown separate from compressor 150; dependent on design preferences, the check valve that is common in the discharge of most compressors may suffice for the purposes of obtaining the desired flow path).

In the second-cylinder only mode of operation a greater amount of energy is consumed by compressor 150 as a larger volume of refrigerant is compressed, providing greater cooling capacity (e.g., to about 40° F. (with a fixed expansion device 120) for the representative compressor cylinder sizes noted above). In this mode of operation, first three-way valve positioned to allow refrigerant flow only between evaporator 130 and a second cylinder suction connection 184; refrigerant compressed in second cylinder 152 passes through second cylinder discharge connection 186 through second three-way valve 182, which is positioned to direct refrigerant flow through a second check valve 189 and thence only into a manifold output header 188, thus bypassing first cylinder 151.

Respective first and second cylinder only operations may also be used to maintain a given refrigerator compartment temperature dependent upon ambient conditions. For example, first cylinder 151 (that is, the smaller volume cylinder) is used when ambient conditions are cool, such as about 50° to 90° F., and second cylinder 152 is used at hotter ambient conditions, such as about 90° to 110° F.

In the combined first and second cylinder in parallel flow path compressor 150 consumes yet more energy and compresses the largest volume of refrigerant of the four modes, and provides about the same differential pressure as in either of the single cylinder modes. In this mode, first three-way valve 181 is positioned to allow refrigerant flow from evaporator 130 to first cylinder suction 183 and to second cylinder suction 184. The compressed refrigerant from first cylinder 151 passes through discharge 185 into output header 188; compressed refrigerant from second cylinder 152 passes through discharge connection 186 and then through second three-way valve 182 which is positioned to direct the compressed refrigerant into output header 188, such that the compressed refrigerant from both first and second cylinders, operating in parallel, passes to condenser 110.

In another mode of operation, first and second cylinders are combined in series operation. This mode consumes the most energy and also provides the greatest pressure differential, with the volume (per compression cycle) determined by the volume of second cylinder 152 (in the example illustrated in FIG. 1), providing the greatest temperature differential to chill air down to about −10° F. in the exemplar sized compressor and type of refrigeration system noted above. In this mode of operation, appropriate for heavy cooling demands in refrigeration system 100, first three-way valve 181 is positioned to direct refrigerant flow from evaporator 130 into second cylinder suction connection 184; compressed refrigerant from second cylinder discharge connection 186 passes through second three-way valve 182, which is positioned to direct refrigerant flow into first cylinder suction connection 183. The refrigerant then undergoes further compression in first cylinder 151 and passes via discharge connection 185 into output header 188.

Alternative plumbing arrangements than those discussed above can be used for coupling the dual cylinder compressor of the present invention with the remainder of the refrigeration system.

The dual cylinder compressor of the present invention is additionally well adapted for use with multiple evaporator refrigeration systems, which require multi-stage compressors. Examples of dual evaporator systems are set out in U.S. Pat. Nos. 4,910,972; 4,918,942; 5,103,650; and 5,134,859, which are assigned to the assignee of the present invention and which are incorporated herein by reference.

While only certain features of the invention have been illustrated and described herein, many modifications and changes will occur to those skilled in the art. It is, therefore, to be understood that the appended claims are intended to cover all such modifications and changes as fall within the true spirit of the invention.

What is claimed is:

1. An energy-efficient refrigeration system comprising:

a compressor apparatus comprising a dual cylinder compressor coupled to an evaporator to receive and compress the refrigerant passing from said evaporator, said compressor comprising a first cylinder, a second cylinder and a first piston and a second piston disposed respectively in said first and second cylinders, said first and second pistons being horizontally opposed and coupled together by a fixed connecting rod; and a compressor controller coupled to said compressor to control compressor capacity by selection of a predetermined refrigerant flow path through said compressor;

said compressor apparatus further comprising at least one refrigerant flow control valve coupled to said compressor controller so as to be responsive to control signals therefrom, said refrigerant flow control valve being disposed in a compressor plumbing manifold connected to said compressor so as to selectively establish said refrigerant flow path.

2. The refrigeration system of claim 1 wherein said predetermined flow paths through said compressor comprise a first-cylinder only flow path and a second-cylinder only flow path.

3. The refrigeration system of claim 2 wherein said predetermined flow paths through said compressor further comprise first and second cylinder series flow path.

4. The refrigeration system of claim 2 wherein said predetermined flow paths through said compressor further comprises a first and second cylinder parallel flow path.

5. The refrigeration system of claim 2 wherein said fixed connecting rod between said first and second pistons is non-pivoting.

6. The refrigeration system of claim 5 wherein said compressor comprises a scotch-yoke drive apparatus.

7. The refrigeration system of claim 5 wherein said compressor comprises a linear voice coil drive apparatus.

8. The refrigeration system of claim 5 wherein the void volume of said first cylinder is less than the void volume of said second cylinder.

9. The refrigeration system of claim 1 wherein said compressor comprises a plurality of refrigerant flow control valves, each of said refrigerant flow control valves being respectively coupled to said compressor controller so as to be responsive to control signals therefrom, said plurality of refrigerant flow control valves being disposed in said compressor plumbing manifold connected to said compressor.

10. The refrigeration system of claim 1 in combination with a refrigerator, said refrigeration system being coupled so as chill air directed to compartments in said refrigerator.

* * * * *